US005720480A

United States Patent [19]

Lawlor et al.

[11] Patent Number: 5,720,480

[45] Date of Patent: Feb. 24, 1998

[54] DISPLAY PANEL FOR A PINBALL MACHINE

[75] Inventors: Patrick Lawlor; John W. Skalon; John Krutsch, all of Chicago, Ill.

[73] Assignee: Williams Electronics Games, Inc., Chicago, Ill.

[21] Appl. No.: 604,470

[22] Filed: Feb. 21, 1996

[51] Int. Cl.[6] ..... A63F 7/36

[52] U.S. Cl. ..... 273/118 A; 273/118 R; 40/564

[58] Field of Search ..... 273/118–121; 40/564, 575, 716

[56] References Cited

U.S. PATENT DOCUMENTS

| | | | |
|---|---|---|---|
| 1,280,051 | 9/1918 | Le Vie | 40/716 X |
| 2,707,346 | 5/1955 | Fuller, Jr. | 40/575 X |
| 2,847,781 | 8/1958 | Van Den Berg | 40/564 |
| 3,413,745 | 12/1968 | Cabe | 40/564 |
| 3,993,312 | 11/1976 | Burnside | 273/121 A |
| 4,096,656 | 6/1978 | Diceglie | 40/564 |
| 4,277,904 | 7/1981 | Leuthesser | 40/564 |
| 4,408,762 | 10/1983 | Brey | 273/121 A |
| 4,648,599 | 3/1987 | Wiczer | 273/121 A |
| 5,267,404 | 12/1993 | Kizy | 40/564 X |
| 5,282,330 | 2/1994 | Hannula | 40/564 X |

*Primary Examiner*—Raleigh W. Chiu
*Attorney, Agent, or Firm*—Rudnick & Wolfe

[57] ABSTRACT

A display panel for a pinball machine utilizes a lightweight plastic housing member with a plurality of apertures therein for retaining light bulbs. A glass lens and film having an image thereon are resiliently retained on the housing member with channel members that extend about the periphery of the lens and housing. The display may be removed and installed as a unitary piece in a pinball game cabinet.

17 Claims, 3 Drawing Sheets

DISPLAY PANEL FOR A PINBALL MACHINE

BACKGROUND OF THE INVENTION

The invention relates generally to pinball and rolling ball games. Specifically, the invention relates to a display panel for displaying indicia to a game player from the back box of a pinball game cabinet.

Pinball games typically comprise an inclined playfield mounted within a game cabinet and supporting one or more rolling game balls. The playfield is provided with a number of play features, such as targets, ramps, bumpers and the like. Players of the game control the rolling ball with flippers to engage play features and accumulate points for scoring purposes.

Revenues derived from play of pinball games depend on the appeal of the game to the general public. Game play must be challenging and exciting. Moreover, for maximum market potential, the game must be aesthetically interesting to players and passers-by alike. Accordingly, much effort has been expended to engineer attractive and exciting means to display the game theme, score and advertising to game players and to the general public.

Efforts to improve pinball games have also focused on reducing the costs associated with production and manufacture of these machines. It is desirable to incorporate lightweight and inexpensive materials in the construction of pinball games and to integrate parts to permit rapid manufacture, assembly and installation.

Prior art display devices display images through an upright panel disposed in the back box of the game cabinet. An image may be screened directly onto a transparent piece of glass or plastic or provided on a piece of plastic film, also known as a translight. FIG. 1 shows a game cabinet of the prior art. Panel member 14 is pivotally mounted to the back box 12. The panel 14 is provided with recesses 20 for housing light bulbs which illuminate an image. When panel 14 is pivoted into back box 12, a glass lens (not shown) may be installed in an upright position in groove 52 and in a groove (not shown) on the underside of top panel 13. Access to the rear of the panel 14 may only be gained by lifting the glass out of the grooves, setting it aside, and pivoting the panel out from back box 12. Thus, for example in order, to replace light bulbs, there is required significant effort. The panel of the prior art also require significant manufacturing effort since each light bulb aperture requires a drilling operation. Thus, significant effort is required for machining the wooden panel. Moreover, prior art devices add significantly to the weight of the machine and their assembly requires the installation of hinges and extra hardware that adds to the cost of production.

There is thus desired an improved display device for pinball games that provides easy accessibility, assembly and installation, and reduces machine weight and manufacturing costs. Moreover, there is desired a display device which may be manufactured quickly and which is easily adaptable to the back box configurations of existing pinball games.

SUMMARY OF THE INVENTION

The present invention solves the problems of the prior art by providing a display device which integrates the light bulbs, panel and back glass into a single lightweight assembly which can be removed and installed as a unit. In a preferred embodiment, the assembly comprises a lightweight plastic panel having a flange about its periphery clamped to the back glass using resilient channel members.

The flange may be provided with a recess for containing a film or translight which has an image thereon. The translight is sandwiched between the glass and flange member. The integrated assembly is adaptable to existing cabinet structures and eliminates the heavy wooden housing members and hinge assemblies of prior art devices. The light panel is provided with a series of apertures for retaining light bulb sockets thereon.

DETAILED DESCRIPTION OF A PREFERRED EMBODIMENT OF THE INVENTION

Figure 1:
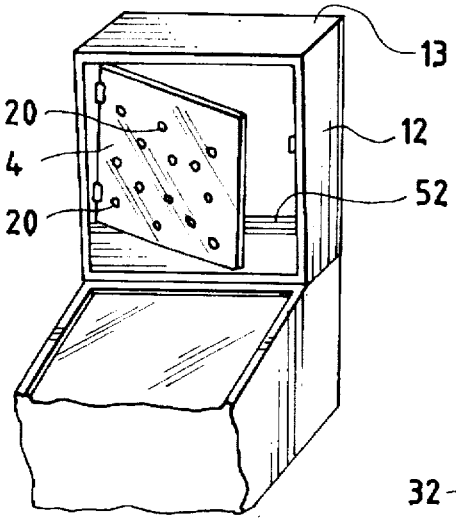
FIG. 1 PRIOR ART
FIG. 1 illustrates a display device and game cabinet of the prior art as discussed above.
Figure 2:
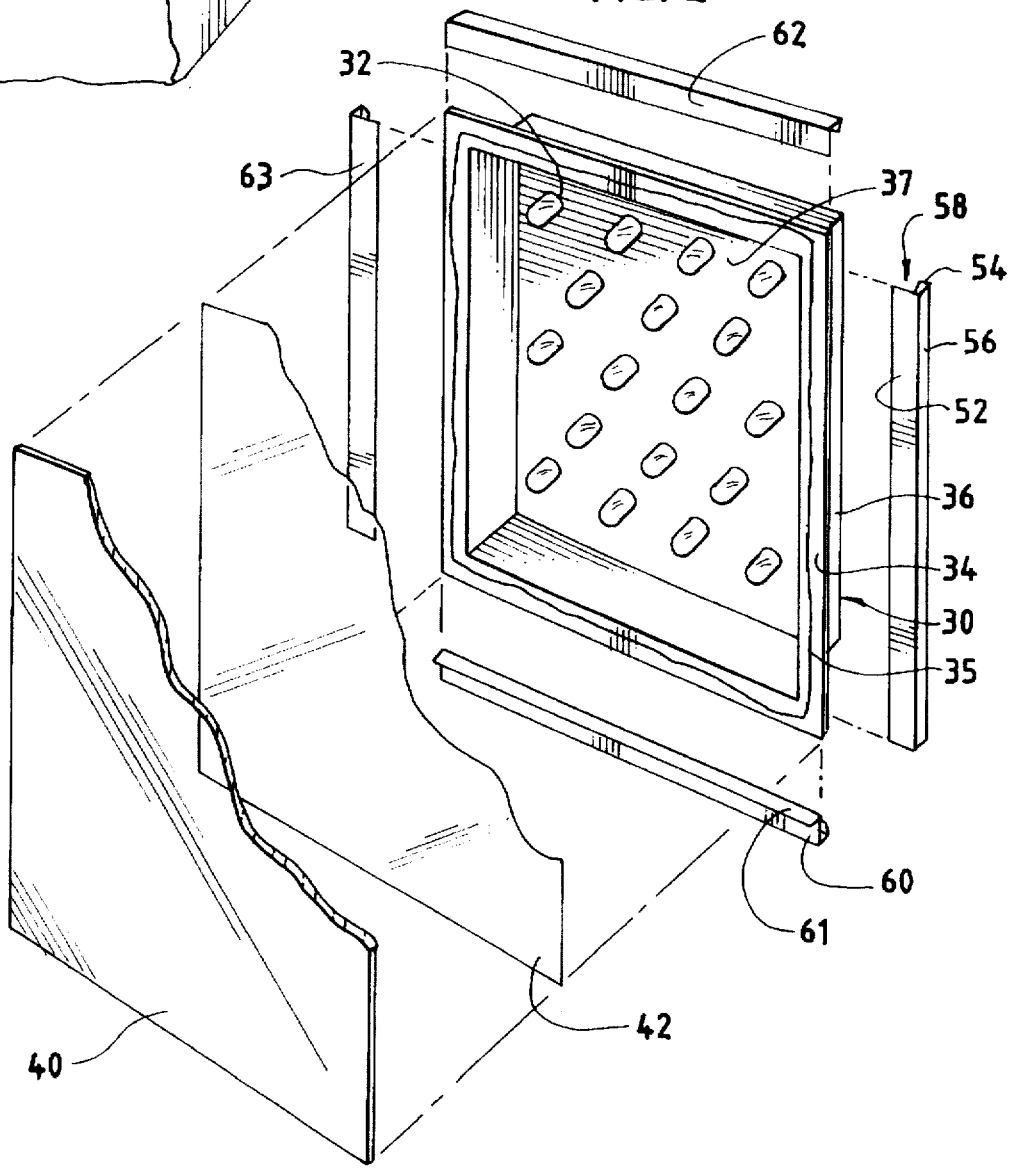
FIG. 2 is an exploded view showing the component parts of a display device according to a preferred embodiment of the invention.
Figure 3:
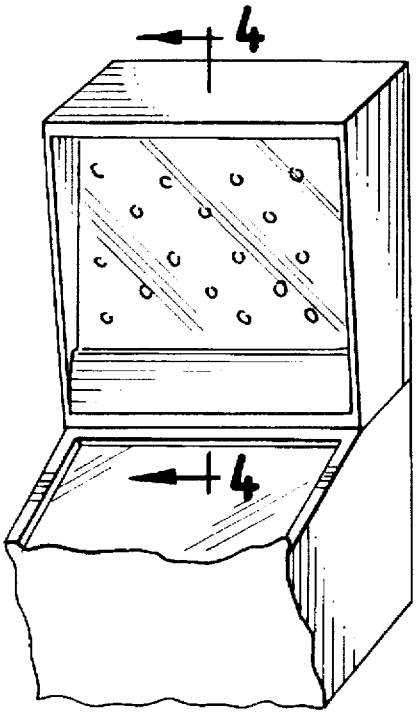
FIG. 3 is a perspective view of a display device and pinball game cabinet according to a preferred embodiment of the present invention.

FIG. 2 illustrates the components of a display panel according to a preferred embodiment of the present invention. A pan-shaped housing member 30 comprises a generally rectangular back panel 37 which is surrounded by a peripheral wall 36 extending at an angle thereto. Extending from wall 36 is a peripheral flange 34 disposed substantially parallel to the back panel 37. Back panel 37 is provided with a number of holes 32 for retaining light bulb sockets therein. Panel member 30 is preferably constructed of temperature resistant lightweight plastic such as polystyrene. Flange 34 is provided on housing member 30 to secure lens 40, which may be constructed of glass or plastic and which may be provided with an image screened directly thereon, or alternatively, with a translight film 42 juxtaposed with lens 40. Recess 35 is provided on flange 34 to permit flush-mounting of translight film 42 therewith. Recess 35 is of a depth corresponding to the thickness of translight film 42 (approximately 0.050"). The panel assembly including housing 30, translight film 42, and lens 40 are held together by resilient channel members 58, 60, 62 and 63.

The channel members are constructed of lightweight resilient plastic such as polyethylene or polystyrene and include two leg members 52 and 54 that extend from a back member 56 to define a channel 58 which is dimensioned to receive and resiliently retain an edge of the lens 40 and an edge of flange 34. Channel members are preferably formed so that leg members 52 and 54 form acute angles with back member 56 when the channels are not installed on the lens and housing. One of the channel members is provided with a lift handle 61 extending from the legs. Channel member 60 having lift handle 61 is installed along the bottom of the insert assembly (FIG. 5) and permits the lifting of the entire assembly out of the lower groove 51 in the box front panel 64 of back box 12 to enable removal of the panel assembly insert. The lower grove is preferably formed in a speaker panel which is separately retained on back box 12 in a known manner.

Figure 4:
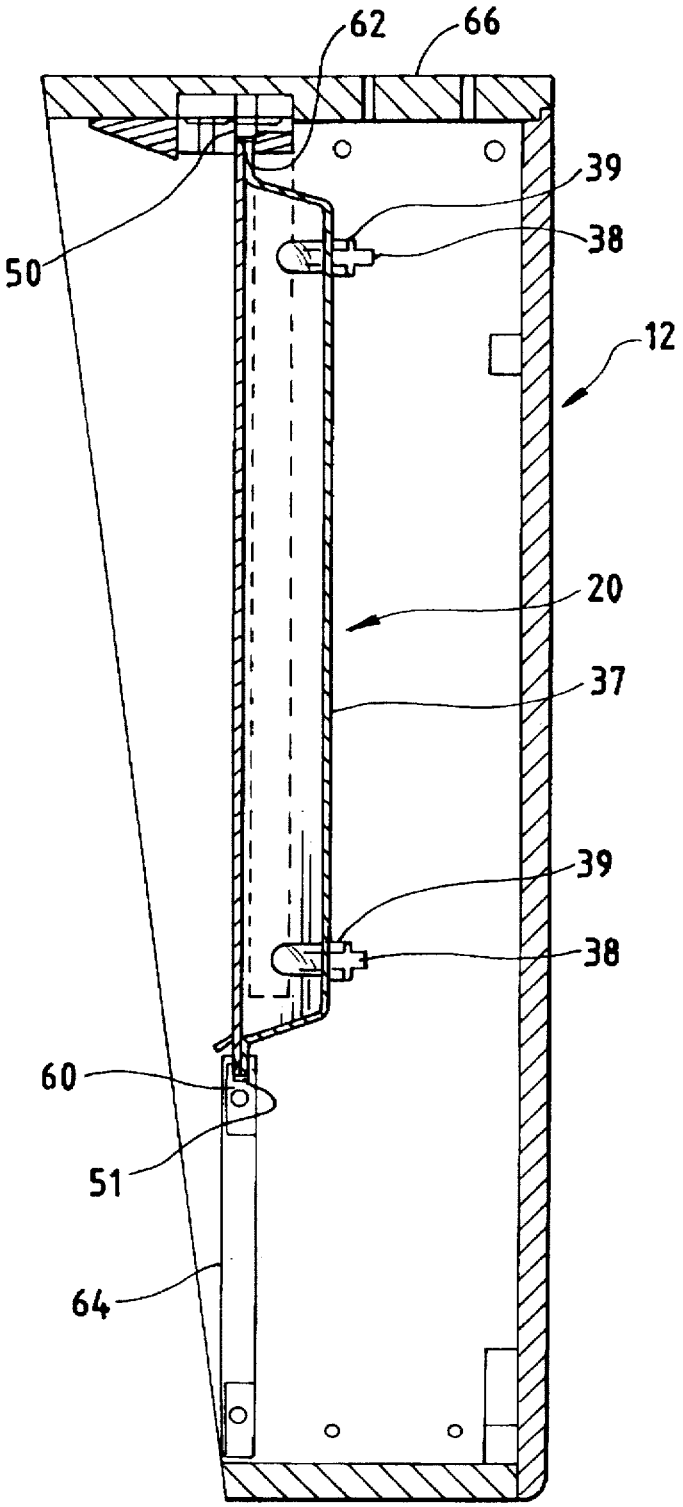
FIG. 4 is a cross-section taken along lines 4—4 of FIG. 3.

FIG. 4 shows a cross-section of display device 20 in its assembled form disposed upright in the back box 12 of a pinball game cabinet. Light bulbs 38 are housed within socket members 39, which are well-known in the art, and affixed to the back panel 37 via, for example, snap-in fittings. Display device 20 is disposed in upper groove 50 and lower groove 51 of back box 12. Channel members 60 and 62 are configured to fit within respective grooves, however, some clearance is preferable between the channels and grooves in order to permit the display panel 20 to be pivoted, and removed from or installed in the game cabinet as described below.

Figure 5:
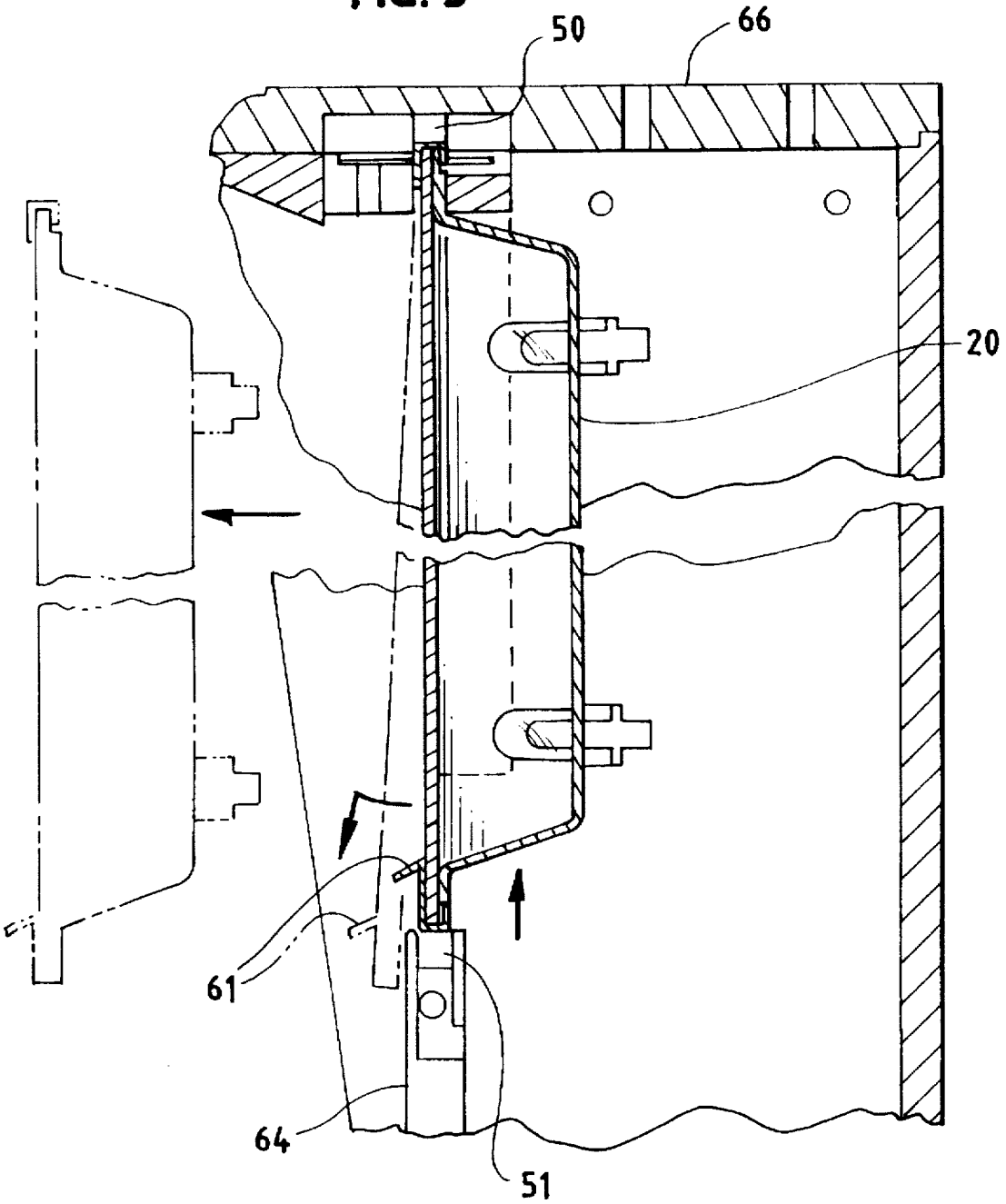
FIG. 5 is a cross-section taken along lines 4—4 of FIG. 3 showing the installation and removal of a display device according to a preferred embodiment of the present invention.

FIG. 5 illustrates the installation and removal of the display panel 20. Installation occurs by moving the device to the position shown in dotted lines. Lift handle 61 is grasped and panel 20 is lifted into top groove 50 of box top panel 66, pivoted counterclockwise to the position shown in solid lines, and then lowered into groove 51. Removal of the display device 20 occurs in the reverse order of the steps described above.

There has thus been described a new and useful device which eliminates the problems of the prior art. It is to be understood that many other constructions and embodiments are possible for the present invention and as defined by the claims that follow.

What is claimed is:

1. A display panel for a pinball game housed within a cabinet having a back box, said panel comprising:

a) a housing member including a generally rectangular back panel, a wall extending peripherally about the back panel, and a flange extending from the wall substantially parallel with the back panel;

b) said back panel having a plurality of holes therethrough with a plurality of lighting elements disposed therein;

c) a transparent cover, for permitting the viewing of indicia by a game player, disposed adjacent to the flange; and d) means for retaining the cover on the flange, whereby the display panel may be installed in the back box of the pinball game cabinet as a unitary piece.

2. The display panel of claim 1, wherein the means for retaining comprises a plurality of channel members disposed about the flange and cover such that the cover is held in place on the housing member by resilient forces.

3. The display panel of claim 2, wherein one of the channel members is provided with a lifting handle for enabling a person to grip and move the display panel with respect to a pinball cabinet.

4. The display panel of claim 2, wherein the channel members are shaped to fit within grooves in the back box.

5. The display panel of claim 1, further comprising a translight film disposed between the flange and the cover and wherein the flange is provided with a recess for receiving the translight film therein.

6. The display panel of claim 1, wherein the housing member is of a homogenous one-piece plastic construction.

7. A pinball game back box comprising:

a) a box top panel having an upper groove therein;

b) a box front panel having a lower groove disposed therein so that the lower groove opposes the upper groove;

c) a display panel including:

i) a housing member for retaining a plurality of lighting elements and including a generally rectangular back panel, a wall extending peripherally about the back panel and a flange extending from the wall substantially parallel with the back panel;

ii) a cover, for permitting the viewing of indicia by a game player, disposed adjacent to the flange;

iii) means for retaining the cover on the flange; and d) said flange of the display panel removably engaging the upper groove and the lower groove.

8. The display panel of claim 7, wherein the means for retaining further comprises at least one resilient channel member disposed on the flange and cover such that the cover is held in place on the flange by resilient forces.

9. The display panel of claim 8, wherein one of the channel members is provided with a lifting handle for enabling a person to grip and move the display panel with respect to the pinball cabinet.

10. The display panel of claim 8, wherein the channel members are shaped to fit within grooves in the back box.

11. The display panel of claim 7, further comprising a translight film disposed between the flange and the cover and wherein the flange is provided with a recess for receiving the translight film therein.

12. The display panel of claim 7, wherein the housing member is of a homogenous one-piece plastic construction.

13. A display panel for a pinball game housed within a cabinet having a black box comprising:

a) a back panel having a plurality of holes therethrough with a plurality of light assemblies disposed therein, a wall extending peripherally about the back panel and a flange extending from the distal end of the wall in a plane substantially parallel to the back panel;

b) indicia disposed in from of said back panel for illumination by said light assemblies;

c) a transparent cover disposed adjacent to the flange to permit viewing of said indicia; and d) means for securing the transparent cover to the flange.

14. The display panel of claim 13, wherein said means for securing comprises at least one channel member.

15. The display panel of claim 14, wherein one of said channel members is provided with a lifting handle.

16. The display panel of claim 14 wherein the channel members are shaped to fit within grooves in the back box.

17. The display panel of claim 13, wherein the back panel, wall and flange are formed in a homogenous one-piece construction.

* * * * *